US007654501B2

(12) United States Patent
Matthews

(10) Patent No.: US 7,654,501 B2
(45) Date of Patent: Feb. 2, 2010

(54) VEHICLE PARKING ASSISTANCE DEVICE AND METHOD FOR USE OF SAME

(76) Inventor: Stewart D. Matthews, 2817 Regal Rd., Sutie 105, Plano, TX (US) 75075

( * ) Notice: Subject to any disclaimer, the term of this patent is extended or adjusted under 35 U.S.C. 154(b) by 0 days.

(21) Appl. No.: 12/134,826

(22) Filed: Jun. 6, 2008

(65) Prior Publication Data

US 2008/0302941 A1 Dec. 11, 2008

Related U.S. Application Data

(60) Provisional application No. 60/942,292, filed on Jun. 6, 2007.

(51) Int. Cl.
*F16M 13/00* (2006.01)

(52) U.S. Cl. ..... 248/523; 248/519; 248/346.01; 116/28 R

(58) Field of Classification Search ..... 248/523, 248/548, 550, 579, 346.01; 116/28 R, 35 R
See application file for complete search history.

(56) References Cited

U.S. PATENT DOCUMENTS

| | | | | |
|---|---|---|---|---|
| 1,828,892 | A * | 10/1931 | Felton | 116/173 |
| 2,296,311 | A | 9/1942 | Schneider | |
| 3,279,133 | A | 10/1966 | De Korte | |
| 3,843,079 | A | 10/1974 | Reisling | |
| 3,977,354 | A | 8/1976 | Mazurek | |
| 4,036,165 | A | 7/1977 | Wood | |
| 4,341,488 | A | 7/1982 | Ryan | |
| D274,412 | S | 6/1984 | Anderson | |
| 5,087,012 | A * | 2/1992 | Doublet | 248/512 |
| 5,094,422 | A * | 3/1992 | Tiffany | 248/519 |
| 5,231,392 | A | 7/1993 | Gust | |
| 5,462,004 | A * | 10/1995 | McGlothin | 116/63 R |
| 5,497,972 | A * | 3/1996 | Sofy | 248/523 |
| D375,911 | S | 11/1996 | Pretsch, Jr. | |
| 5,841,368 | A | 11/1998 | Bryant | |
| 6,138,978 | A | 10/2000 | Anderson | |
| 6,755,311 | B2 * | 6/2004 | Berry | 211/70.6 |
| 6,889,953 | B2 * | 5/2005 | Harbaugh | 248/519 |
| 7,021,237 | B1 * | 4/2006 | Benjamin | 116/28 R |
| 2006/0179671 | A1 | 8/2006 | Ghatak | |
| 2007/0080277 | A1 * | 4/2007 | Chen | 248/354.3 |

* cited by examiner

*Primary Examiner*—Anita M King
(74) *Attorney, Agent, or Firm*—Scott T. Griggs; Griggs Bergen LLP

(57) ABSTRACT

A vehicle parking assistance device to be positioned in a given parking location defined by a length and width is disclosed. In one embodiment, a support base member includes three bores disposed in linear alignment therein. Each of the three bores provides a distinct position within the length and the width of the given parking location. An elongated flexible pole having a visual indicator secured thereto is releasably engaged in one of the three bores. The three bores furnish easy adjustment of the placement of the elongated flexible pole in order to compensate for minor mistakes in the placement of the vehicle parking device and/or to accommodate vehicles of different dimensions.

6 Claims, 2 Drawing Sheets

VEHICLE PARKING ASSISTANCE DEVICE AND METHOD FOR USE OF SAME

PRIORITY STATEMENT & CROSS-REFERENCE TO RELATED APPLICATIONS

This application claims priority from U.S. Patent Application No. 60/942,292, entitled "Vehicle Parking Assistance Device and Method for Use of Same" and filed on Jun. 6, 2007, in the name of Stewart D. Matthews; which is hereby incorporated by reference for all purposes.

TECHNICAL FIELD OF THE INVENTION

This invention relates, in general, to vehicle parking and, in particular, to a vehicle parking assistance device and accompanying method that signals a driver when the vehicle is positioned within a designated parking location, such as a parking space.

BACKGROUND OF THE INVENTION

Existing vehicle parking assistance devices, which signal to a driver when a vehicle has reached a selected point and should be stopped, in the marketplace have limitations. By way of example, laser-based systems are expensive and difficult to install. Curb-based objects which are attached to pads are inadequate as such devices rely on the visual perception of the driver to ensure that the vehicle approach is correct and within a tight and often difficult to define range. Tennis balls hung on a string from a ceiling are dangerous to install, often in the way, and difficult to adjust to compensate for differing car lengths. Accordingly, a need exists for an improved vehicle parking assistance device which addresses these deficiencies.

SUMMARY OF THE INVENTION

A vehicle parking assistance device to be positioned in a given parking location defined by a length and width is disclosed. The vehicle parking assistance device aids a driver of a vehicle in correctly positioning the vehicle within the given parking location. In one embodiment, a support base member includes three bores disposed in linear alignment therein. Each of the three bores provides a distinct position within the length and the width of the given parking location for accepting an elongated flexible pole which includes an upper end and a lower end that is releasably engaged in one of the three bores. A visual indicator is secured to the upper end of the elongated flexible pole. The three bores furnish easy adjustment of the placement of the elongated flexible pole in order to compensate for minor mistakes in the placement of the support base member of the vehicle parking device and/or to accommodate vehicles of different dimensions.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
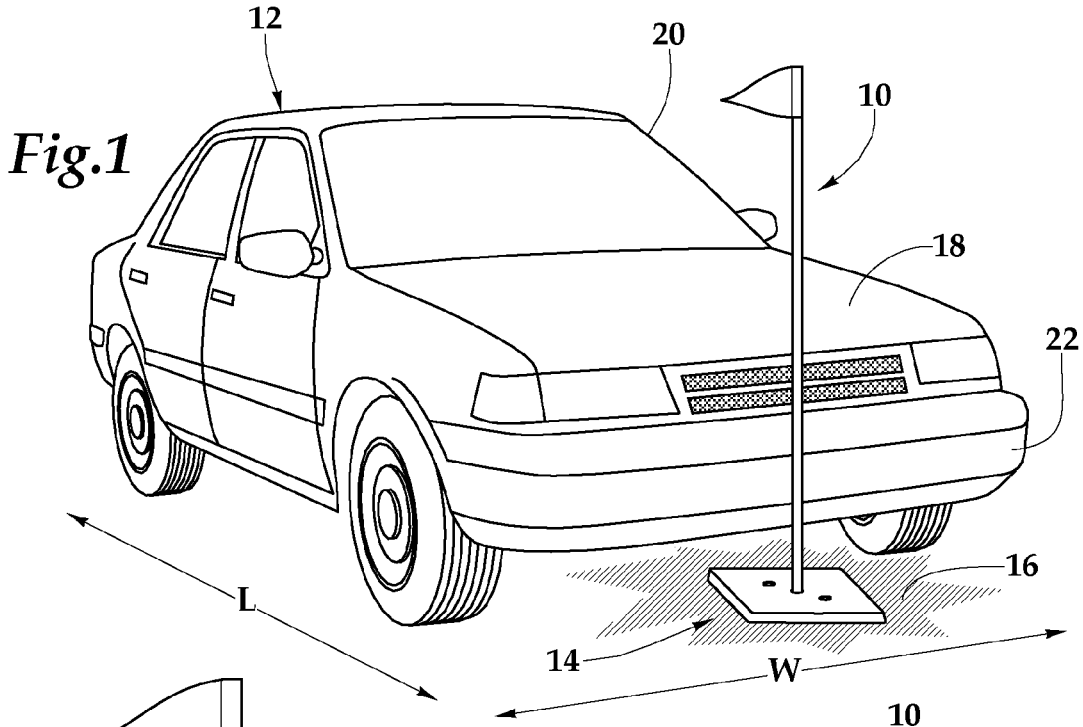
FIG. 1 is a perspective pictorial view of one embodiment of a vehicle parking assistance device being engaged by a vehicle, wherein a visual indicator of the vehicle parking assistance device is visible to a driver of the vehicle.

Referring initially to FIG. 1, therein is depicted a vehicle parking assistance device that is schematically illustrated and generally designated 10. A vehicle 12 is parking in a designated parking location 14 which has a particular length L and width W. The vehicle parking assistance device 10 is located at the edge of the given parking location 14 on a surface 16. As the vehicle drives into the designated parking location 14, a driver of the vehicle 12 is able to visually see the vehicle parking assistance device 10 over a hood 18 and through a windshield 20. When a bumper 22 of the vehicle 22 contacts the vehicle parking assistance device 10, the vehicle parking assistance device 10 is displaced to provide a visual indication to the driver that a pre-selected point has been reached and the vehicle 12 should be halted immediately.

Figure 3:
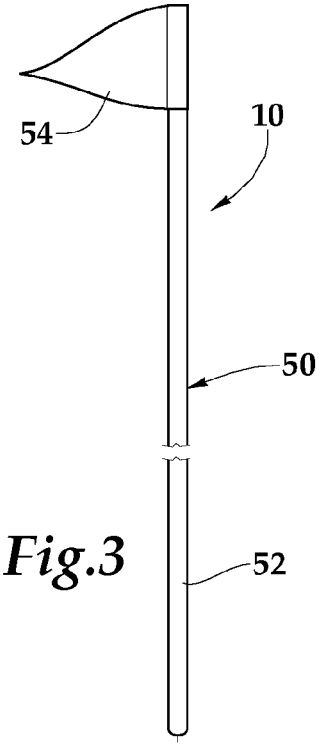
FIG. 3 is an exploded perspective view of the vehicle parking assistance device of FIG. 1.
Figure 2:
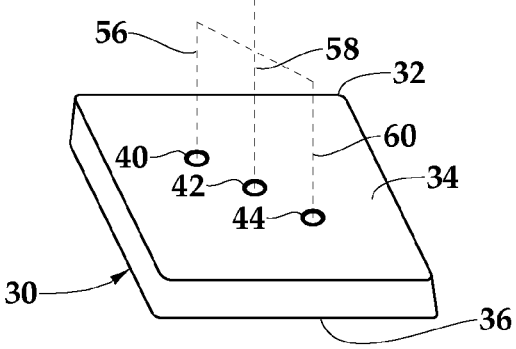
FIG. 2 is a perspective view of the vehicle parking assistance device of FIG. 1.
Figure 2:
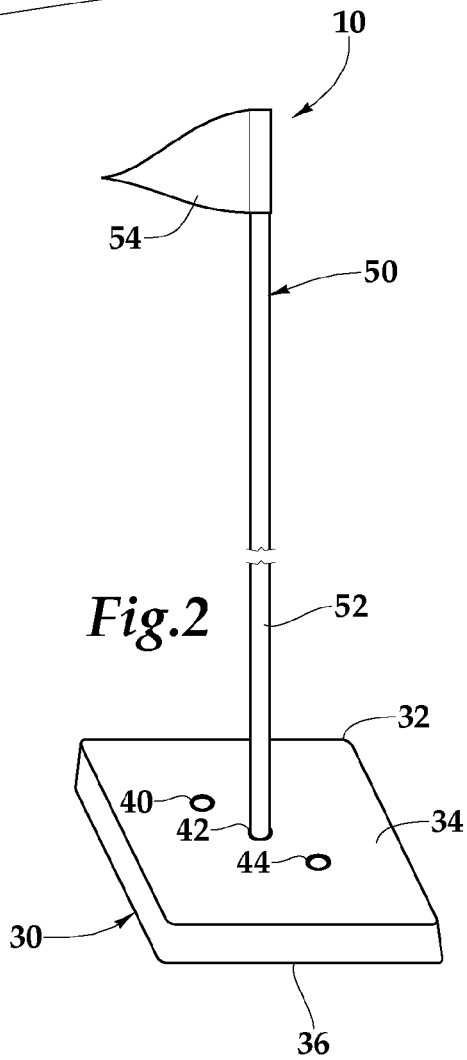
Figure 4:
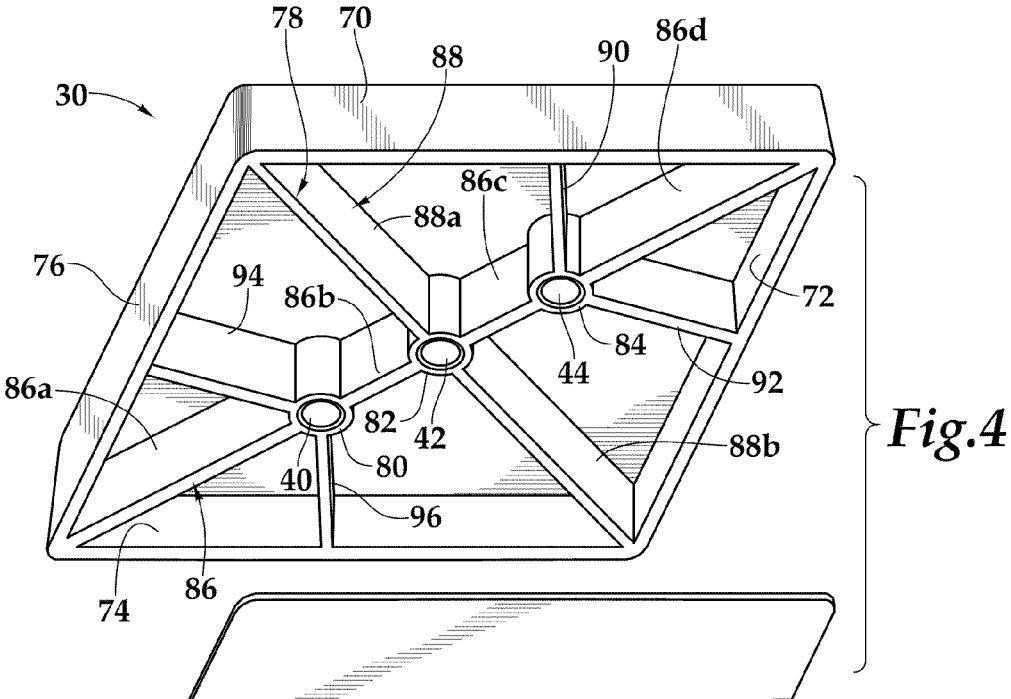
FIG. 4 is bottom exploded perspective view of a portion of the vehicle parking assistance device of FIG. 1.

Referring now to FIGS. 2 through 4, the vehicle parking assistance device 10 includes a support base member 30 having three bores 40, 42, 44 disposed in linear alignment therein. It should be appreciated that although three bores are depicted linearly aligned, other numbers and alignments of bores are within the teachings of the present invention. As will be discussed in further detail hereinbelow, each of the three bores 40, 42, 44 provides a distinct position within the length L and the width W of the given parking location 14. A sensor arm 50 includes an elongated flexible pole 52 having an upper end and a lower end thereof which is releasably engaged in one of the three bores 40, 42, 44. A visual indicator 54, such as a flag, secured to the upper end of the elongated flexible pole 52 also forms a portion of the sensor arm 50. The sensor arm 50 may comprise a pole of graphite or other material having a flag (or ball) or other piece of light-reflective material attached to the upper end. As illustrated, three alignments 56, 58, 60 are possible for the elongated flag pole 52 and furnished by the three respective bores 40, 42, 44.

An upper surface 32 of the support base member 30 includes an upper panel 34 and a lower surface 36 includes a lower panel 38. Four side panels 70, 72, 74, 76 form a rectangular-shaped exterior having four corners at the junctions of side panels 70, 72; side panels 72, 74; side panels 74, 76; and side panels 76, 70. A support skeleton 78 includes cross members 86, 88 that form an X-shaped support skeleton portion of the support skeleton 78 by joining the support skeleton 78 with the four corners formed by the four side panels 70, 72, 74, 76 and intersecting three support pillars 80, 82, 84. The cross member 86 includes segments 86*a*, 86*b*, 86*c*, and 86*d* and the cross member 88 includes segments 88*a* and 88*b*. The three support pillars 80, 82, 84 respectively have the bores 40, 42, 44 intersecting therethrough and are adapted to accept and releasably secure the elongated flexible pole 52 therein. Support members 90, 92, 94, 96 span spaces between the rectangular-shaped exterior created by the four side panels 70, 72, 74, 76 and two of the three support pillars, i.e., support pillars 80, 84.

The support base member 30 may be of any size and shape and may include any number of support pillars. Preferably, the support base member 30 comprises a light weight construction that offers sufficient stability for parking tasks. The lower surface 36 of the support base member may include an adhesive layer affixed to the lower panel 38 for securing the vehicle parking assistance device 10 to a surface, such as a concrete floor, for example. It should be appreciated that although the support base member 30 is described as having separate components, the components of the support base member 30 may be integrally formed. Further, it should also be appreciated that the internal structural components of the support base member 30 may vary from that presented herein.

Figure 5:
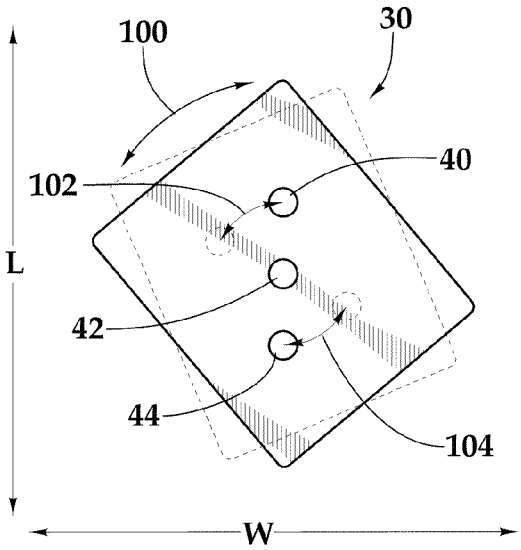
FIG. 5 is a top plan view graphically illustrating the relationship between an orientation of the vehicle parking assistance device of FIG. 1 and positioning options for the visual indicator.

FIG. 5 depicts the relationship between an orientation of the vehicle parking assistance device 10 and positioning options for the sensor arm 50. As previously mentioned, the three distinct alignments 56, 58, 60 or positions provided by the respective three bores 40, 42, 44 furnish compensation for minor mistakes in the placement of the vehicle parking assistance device 10 and accommodation for vehicles of different dimensions. More particularly, each of the three bores 40, 42, 44 provides a distinct position within the length L and the width W of the given parking location. In the illustrated implementation, the bore 42 is a center bore that is aligned with the center of the support base member 30. The bores 40, 44 are first and second outside bores that are equally and opposingly spaced about the center bore 42. To further expand the alignment opportunities provided by the vehicle parking assistance device 10, as best seen in FIG. 5, by rotating the support base member 30 as shown by arrow 100, the locations of the respective bores 40, 42 are displaced as indicated by arrows 102, 104, thereby increasing the alignment options.

In operation, the support base member 30 is disposed at the edge of the given parking location 14. The individual that placed the support base member 30 may then select, based upon minor mistakes in placement of the support base member 30 and accommodation for dimensions of the vehicle 12, a position for the elongated flexible pole 52 from one of the three bores 40, 42, 44 and the corresponding alignments 45, 58, 60. The elongated flexible pole 52 releasably engages the selected bore such that a visual indicator 54 secured to the upper end of the elongated flexible pole 52 is displayed. The three support pillars 80, 82, 84 provide for easy adjustment of the location of the sensor arm 50. If the position initially selected for the elongated flexible pole 52 is not suitable, then the position for the elongated flexible pole 52 may be re-selected. The elongated flexible pole 52 is disengaged from the selected bore and then re-engaged into the re-selected bore.

Figure 6:
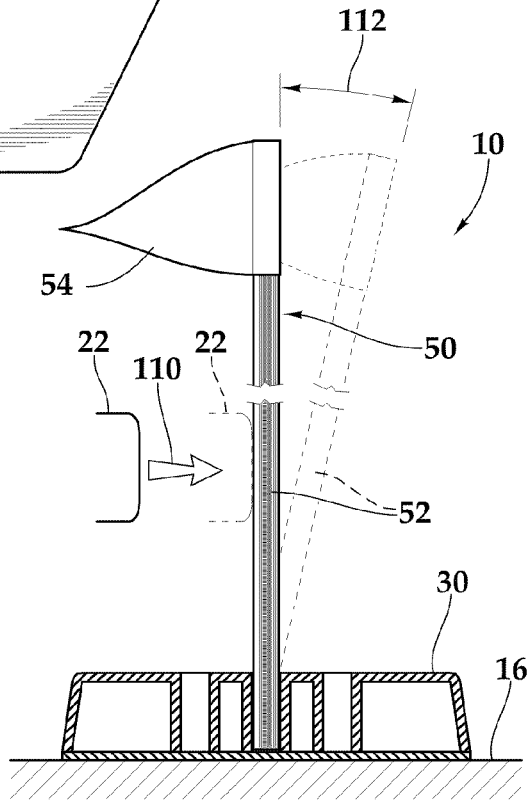
FIG. 6 is a side plan view in partial cross-section of one operational embodiment of the vehicle parking assistance device of FIG. 1.

FIG. 6 depicts one operational embodiment of the vehicle parking assistance device 10. As depicted, the vehicle parking assistance device 10 is being used by the driver of the vehicle 12 to indicate when the vehicle 12 has reached a selected point and should be stopped in order to prevent damage to the vehicle as well as parking location 14 and/or garage. The vehicle 10 as depicted by bumper 22 approaches the parking assistance device 10 which has been previously appropriately positioned in a parking space. The support base member 30 of the parking assistance device 10 may have been secured to the given parking location 14 or, alternatively, repositioned as required within the given parking location 14 or moved from one parking location to another.

When the bumper 22 contacts the sensor arm as shown by arrow 110, the displacement or movement of the sensor arm 50, as depicted by arrow 112, is observed by the driver, thereby indicating that the vehicle has reached a pre-selected point and should be stopped immediately. More particularly, in response to contact from the vehicle 12, the elongated flexible pole 52 is displaced which causes the movement of the visual indicator 54.

When the vehicle 12 is backed away from the sensor arm 50, the sensor arm 50 returns to its original position in readiness for operation again. Additionally, when the vehicle parking assistance device 10 is not in use, the sensor arm 50 may be removed from the support base member 30, leaving a low, substantially floor level support base member 30 having a profile which minimally interferes with the surrounding environment. Once the elongated flexible pole 52 is removed from the support base member 30, the sensor arm 50 may be easily stored.

In other implementations, one or more parking assistance devices 10 are utilized to block off an area for non-parking or non-entrance. Further, in the embodiment where the visual indicator 54 is a flag, the flag may carry promotional materials to advertise a business, team, or other organization.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A vehicle parking assistance device to be positioned in a given parking location defined by a length and width, the vehicle parking assistance device to aid a driver of a vehicle in correctly positioning the vehicle within the given parking location, the vehicle parking assistance device comprising:

a support base member including three support pillars, four side panels forming a rectangular-shaped exterior having four corners, first and second cross members forming an X-shaped support skeleton, and a plurality of support members spanning spaces between the rectangular-shaped exterior and two of the three support pillars;

three support pillars having three bores disposed therethrough in linear alignment within the support base member, each of the three support pillars adapted to accept a pole, each of the three bores providing a distinct position within the length and the width of the given parking location, the X-shaped support skeleton joining with the four corners and intersecting the three support pillars;

an elongated flexible pole having an upper end and a lower end thereof releasably engaged in one of the three bores of the respective three support pillars; and a visual indicator secured to the upper end, wherein the three distinct positions provided by the respective three bores furnish compensation for minor mistakes in the placement of the vehicle parking device and accommodation for vehicles of different dimensions.

2. The vehicle parking assistance device as recited in claim 1, wherein the visual indicator comprises a flag.

3. The vehicle parking assistance device as recited in claim 1, wherein the support base member is integrally formed.

4. A vehicle parking assistance device to be positioned in a given parking location defined by a length and width, the vehicle parking assistance device to aid a driver of a vehicle in correctly positioning the vehicle within the given parking location, the vehicle parking assistance device comprising:

a support base member including a center, three support pillars, four side panels forming a rectangular-shaped exterior having four corners, first and second cross members forming an X-shaped support skeleton, and a plurality of support members spanning spaces between the rectangular-shaped exterior and two of the three support pillars;

three support pillars having three bores disposed in linear alignment within the support base member, each of the three support pillars adapted to accept a pole, each of the three bores providing a distinct position within the length and the width of the given parking location, a center bore of these three bores being aligned with the center of the support base member, first and second outside bores of the three bores being opposingly spaced about the center bore, the X-shaped support skeleton joining with the four corners and intersecting the three support pillars;

an elongated flexible pole having an upper end and a lower end thereof releasably engaged in one of the three bores of the respective three support pillars; and a visual indicator secured to the upper end, wherein the three distinct positions provided by the respective three bores furnish compensation for minor mistakes in the placement of the vehicle parking device and accommodation for vehicles of different dimensions.

5. The vehicle parking assistance device as recited in claim 4, wherein the visual indicator comprises a flag.

6. The vehicle parking assistance device as recited in claim 4, wherein the support base member is integrally formed.

* * * * *